US011230358B2

(12) United States Patent
Richard

(10) Patent No.: US 11,230,358 B2
(45) Date of Patent: Jan. 25, 2022

(54) INFLATABLE FLOTATION DEVICE

(71) Applicant: BB-C Technologies Inc., Cole Harbour (CA)

(72) Inventor: Sebastien Richard, Montreal (CA)

(73) Assignee: BB-C TECHNOLOGIES INC., Darmouth (CA)

( * ) Notice: Subject to any disclaimer, the term of this patent is extended or adjusted under 35 U.S.C. 154(b) by 0 days.

(21) Appl. No.: 17/078,748

(22) Filed: Oct. 23, 2020

(65) Prior Publication Data

US 2021/0139119 A1 May 13, 2021

Related U.S. Application Data

(60) Provisional application No. 62/932,145, filed on Nov. 7, 2019.

(51) Int. Cl.
*B63C 9/15* (2006.01)
*B63C 9/125* (2006.01)

(52) U.S. Cl.
CPC ..... *B63C 9/155* (2013.01); *B63C 9/1255* (2013.01)

(58) Field of Classification Search
CPC ..... B63C 9/155; B63C 9/1255
See application file for complete search history.

(56) References Cited

U.S. PATENT DOCUMENTS 5,867,842 A * 2/1999 Pinsley ..... A41D 13/018 2/462
11,112,016 B2 * 9/2021 Wiktorko ..... F16L 55/136
2021/0139119 A1 * 5/2021 Richard ..... B63C 9/18

FOREIGN PATENT DOCUMENTS

CA 2720574 5/2012
CA 2805051 7/2014

* cited by examiner

*Primary Examiner* — S. Joseph Morano
*Assistant Examiner* — Jovon E Hayes

(57) ABSTRACT

An inflatable flotation device including two panels extending from a body an inflatable bladder. The two panels and the body may be closed to enclose the inflatable bladder with the two panels attached to each other using magnets. When the inflatable bladder is inflated, the magnets separate from each other and the two panels open up to expose the inflatable bladder and allow further inflation.

16 Claims, 3 Drawing Sheets

INFLATABLE FLOTATION DEVICE

FIELD OF THE INVENTION

Figure 1:
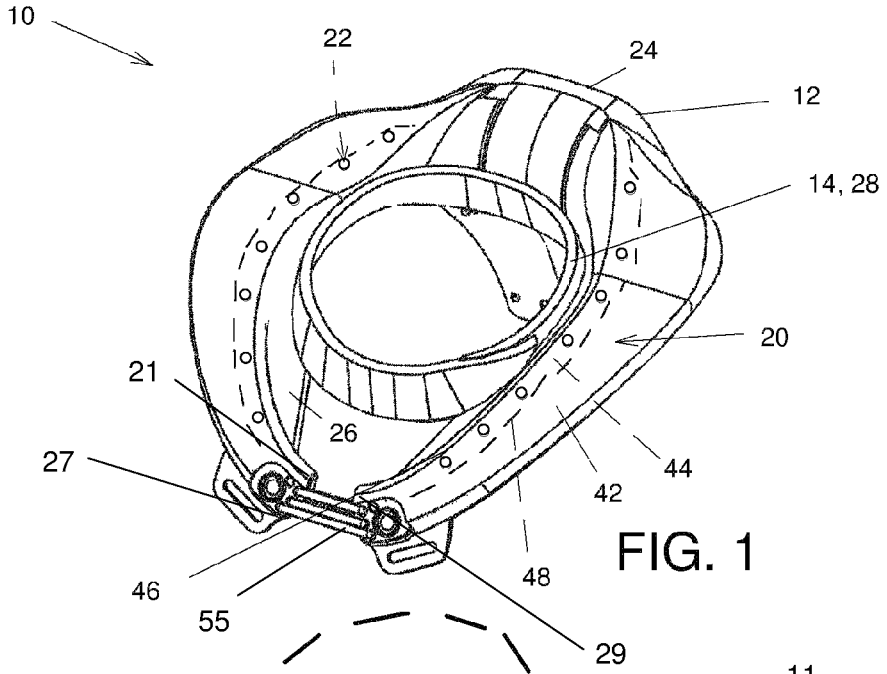

The present invention relates to general field of safety equipment. More specifically, the present invention is concerned with an inflatable flotation device.

BACKGROUND

Life jacket are useful in situations in which one may fall unexpectedly in water and therefore risk drowning. However, they are cumbersome and therefore often not used, even in situations in which they are legally mandatory. There are inflatable devices that can be worn instead of a life jacket and that can either inflate manually or automatically when submerged. Such devices usually include a soft shell including two panels attached to each other through patches of complementary miniature hook and loop materials, known more commonly as Velcro™. The shell contains a bladder that can be inflated through a gas cartridge. When inflating, the shell splits into two parts by separating along the Velcro. Once the device has been inflated and the user has reached safety, the bladder is deflated, the cartridge is replaced and the shell can be closed. Closing the shell can be somewhat difficult as the Velcro needs to be precisely aligned. Also, the force required to open the shell will depend on the alignment between complementary patches of Velcro, which may cause a slow or too rapid opening if the Velcro is not properly aligned.

Against this background, there exists a need in the industry to provide novel flotation devices. An object of the present invention is therefore to provide such flotation devices.

SUMMARY OF THE INVENTION

In a first broad aspect, there is provided an inflatable flotation device wearable by an intended user, comprising: a body; a mounting system operatively coupled to the body for mounting the inflatable flotation device to the intended user; an inflatable bladder mounted to the body and configurable between a deflated configuration and an inflated configuration; an inflation system for selectively inflating the bladder from the deflated configuration to the inflated configuration, the inflation system including a cartridge containing a compressed fluid and a valve between the bladder and the cartridge, the valve being selectively openable to allow the compressed fluid to flow from the cartridge to the bladder; first and second panels defining respectively first and second free edges, the first and second panels extending from the body from opposite the first and second free edges, the body extending between the first and second panels, the first and second panels being configurable between a closed configuration and an open configuration, wherein, in the closed configuration, the first and second panels overlap each other adjacent the first and second free edges and the first and second panels and the body together define a cavity, the inflatable bladder being enclosed in the deflated configuration within the cavity, and, in the open configuration, the first and second panels are detached from each other at the first and second free edges with the first and second free edges spaced apart from each other so that the inflatable bladder is exposed; an attachment system including a first magnet and a second magnet mounted respectively to the first and second panels respectively at the first and second free edges, the first and second magnets being positioned so that in the closed configuration, the first and second magnets are substantially in register with each other and face each other with opposite polarities to attach the first and second panels to each other so that a predetermined force is required to detach the first and second panels from each other to achieve the open configuration.

There may also be provided an inflatable flotation device wherein the first and second panels are flexible so that the first and second panels deform when the first and second panels move between the open en closed configurations.

There may also be provided an inflatable flotation device wherein the first and second panels are made of fabric.

There may also be provided an inflatable flotation device wherein the body is substantially rigid so that the body is substantially undeformed when the first and second panels move between the open en closed configurations.

There may also be provided an inflatable flotation device wherein the body is made of a polymer.

There may also be provided an inflatable flotation device wherein the body is less flexible than the first and second panels.

There may also be provided an inflatable flotation device wherein the mounting system includes a collar for mounting the inflatable flotation device around a neck of the intended user.

There may also be provided an inflatable flotation device wherein the mounting system includes a harness for mounting the inflatable flotation device around a torso of the intended user.

There may also be provided an inflatable flotation device wherein the body is substantially U-shaped and defines two body ends.

There may also be provided an inflatable flotation device wherein the body is provided with a body attachment for selectively attaching the two body ends to each other.

There may also be provided an inflatable flotation device wherein the first and second magnets are elongated and extend respectively along at least 50% of the first and second free edges.

There may also be provided an inflatable flotation device wherein the attachment system including a plurality of first panel magnets mounted to the first panel spaced apart from each other along the first free edge and a plurality of second panel magnets mounted to the second panel spaced apart from each other along the second free edge, the first and second magnets being respectively part of the plurality of first and second panel magnets, each of the magnets from the plurality of first panel magnets facing and attracting a respective magnet from the plurality of second panel magnets in the closed configuration.

In another broad aspect, there is provided a method of operating an inflatable flotation device, the inflatable flotation device including an inflatable bladder and first and second panels extending from a body provided therebetween, the first and second panels defining respectively first and second free edges opposed to the body, the first and second panels being provided with respectively first and second magnets at respectively the first and second free edges, the method comprising: (a) closing the first and second panels with the first and second panels overlapping each other at the first and second free edges so that the first and second panels and body enclose the inflatable bladder deflated and so that the first and second magnets attract each other; (b) after step (a), inflating the inflatable bladder until the inflatable bladder abuts against the first and second panels; and (c) after step (b), continuing inflation the inflatable bladder to cause the first and second magnets and moves away from each other to open the first and second panels to expose the inflatable bladder and allow further inflation of the inflatable bladder.

There may also be provided a method wherein inflating the inflatable bladder includes breaking a seal between a compressed fluid cartridge and the inflatable bladder and transferring a compressed fluid from the compressed fluid cartridge to the inflatable bladder.

There may also be provided method further comprising, after step (c), deflating the inflatable bladder and performing step (a) again.

In another broad aspect, there is provided an inflatable flotation device wearable by an intended user and usable with an inflation system able to selectively provide a pressurized fluid, the inflatable flotation device comprising: a body; a mounting system operatively coupled to the body for mounting the inflatable flotation device to the intended user; an inflatable bladder mounted to the body and configurable between a deflated configuration and an inflated configuration, the inflatable bladder being adapted to receive the compressed fluid from the inflation system to change from the deflated configuration to the inflated configuration; first and second panels defining respectively first and second free edges, the first and second panels extending from the body from opposite the first and second free edges, the body extending between the first and second panels, the first and second panels being configurable between a closed configuration and an open configuration, wherein, in the closed configuration, the first and second panels overlap each other adjacent the first and second free edges and the first and second panels and the body together define a cavity, the inflatable bladder being enclosed in the deflated configuration within the cavity, and, in the open configuration, the first and second panels are detached from each other at the first and second free edges with the first and second free edges spaced apart from each other so that the inflatable bladder is exposed; an attachment system including a first magnet and a second magnet mounted respectively to the first and second panels respectively at the first and second free edges, the first and second magnets being positioned so that in the closed configuration, the first and second magnets are substantially in register with each other and face each other with opposite polarities to attach the first and second panels to each other so that a predetermined force is required to detach the first and second panels from each other to achieve the open configuration.

Advantageously, the proposed flotation device ensures consistency in the amount of force required for opening upon inflation. Such consistency is important to ensure that inflation doe not lead to a too sudden detachments of the too panels, while ensuring that detachment will occur only upon inflation, and not accidentally, which could expose the inflatable bladder do damages. Also, repacking the inflatable bladder after it has been inflated for subsequent use in the deflated configuration is facilitated by the mutual attraction of the magnets. Yet furthermore, if the magnets are strong enough, they can be used to attract small metallic objects and secure them to the flotation device, such as fishing articles, for example fishing hooks.

Other objects, advantages and features of the present invention will become more apparent upon reading of the following non-restrictive description of preferred embodiments thereof, given by way of example only with reference to the accompanying drawings.

BRIEF DESCRIPTION FOR DRAWINGS

Figure 2:
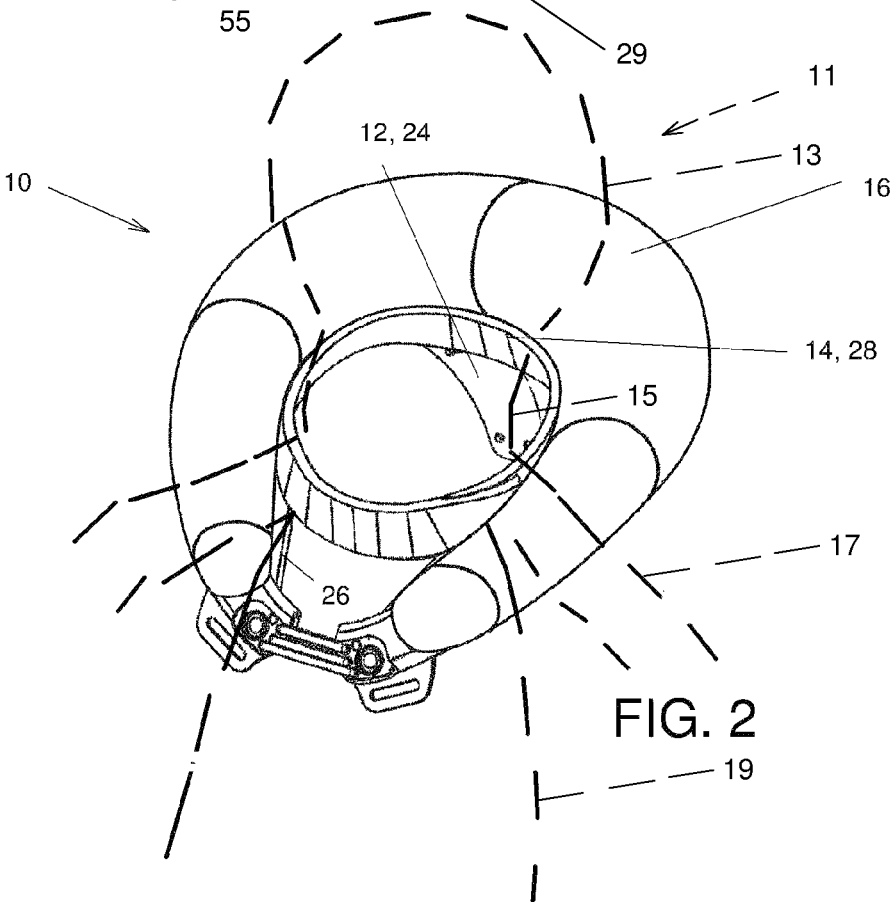
Figure 3:
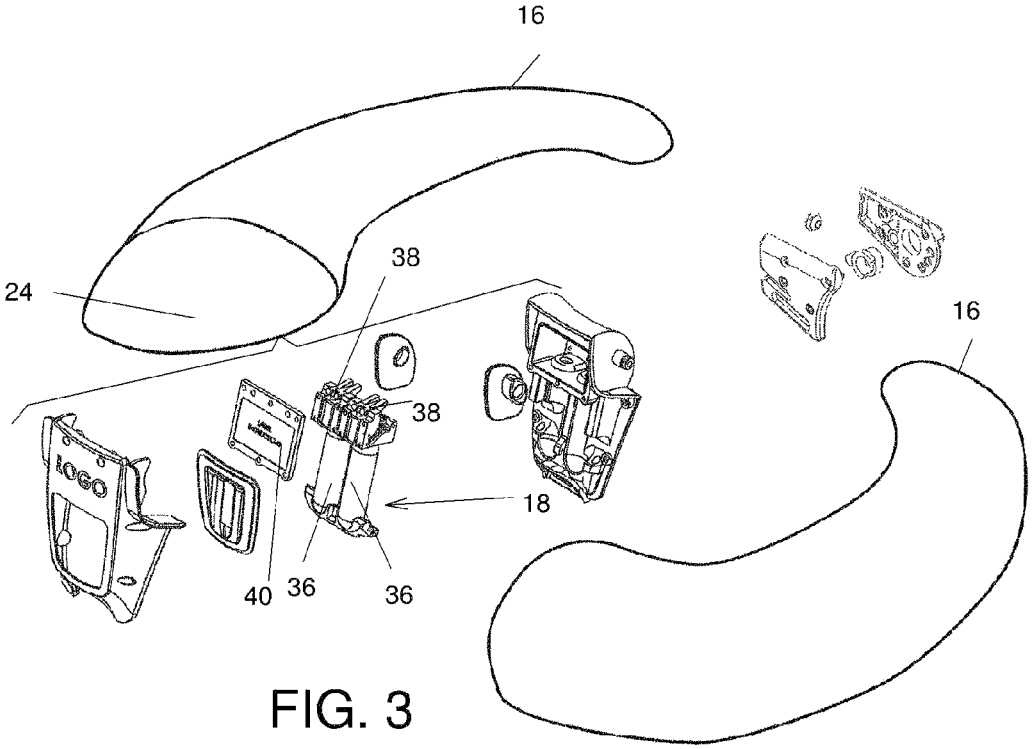
Figure 6:
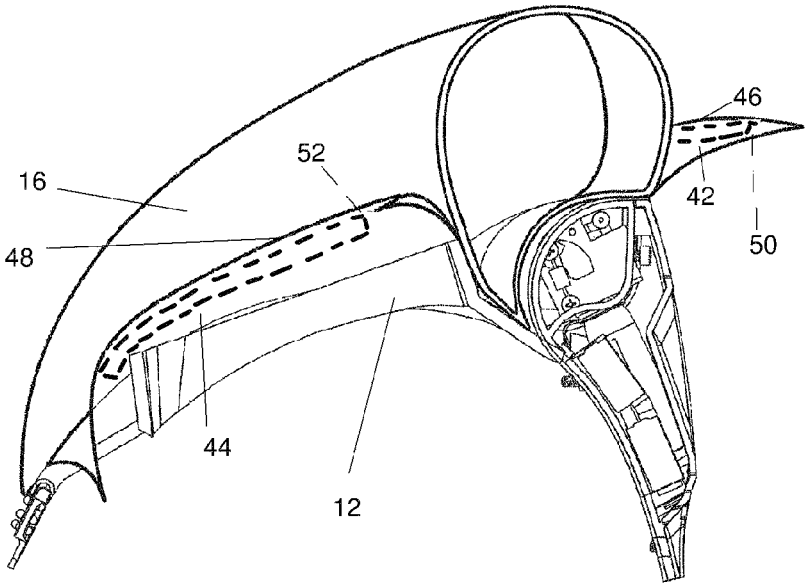
Figure 4:
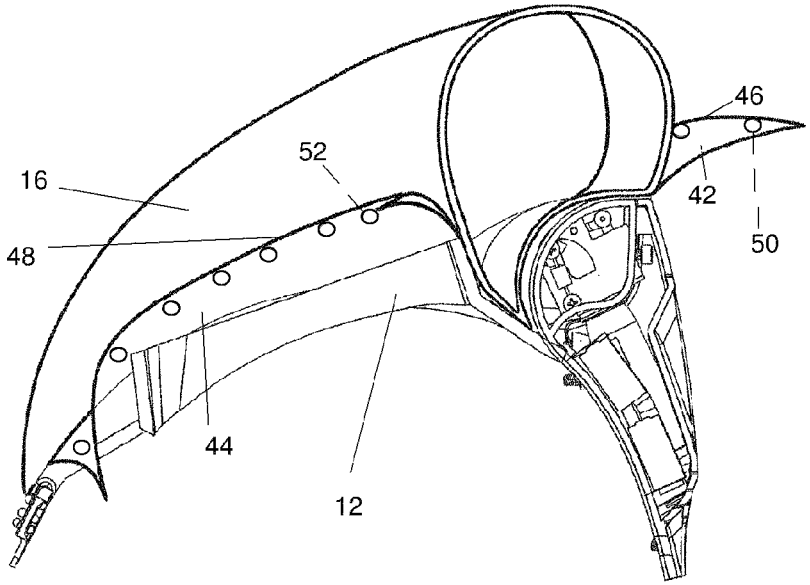
Figure 5:
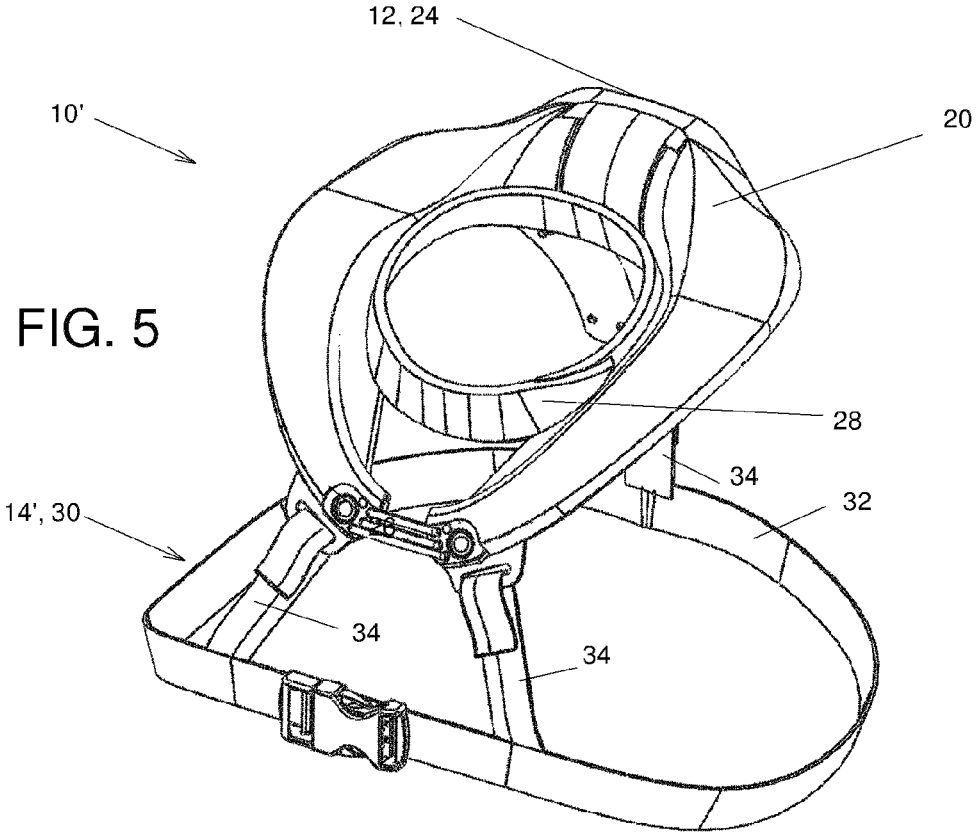

In the appended drawings:

FIG. 1, in a perspective view, illustrates an inflatable flotation device in accordance with an embodiment of the present invention, the device being shown with an inflatable bladder thereof in a deflated configuration;

FIG. 2, in a perspective view, illustrates the device of FIG. 1 with the inflatable bladder in an inflated configuration;

FIG. 3, in a perspective exploded view with parts removed, illustrates the device of FIGS. 1 and 2;

FIG. 4, in a partial perspective cross-sectional view, illustrates the device of FIGS. 1 to 3;

FIG. 5, in a perspective view, illustrates an inflatable flotation device in accordance with an alternative embodiment of the present invention; and FIG. 6, in a partial perspective cross-sectional view, illustrates a flotation device in accordance with an alternative embodiment of the present invention.

DETAILED DESCRIPTION

Referring to FIGS. 1 and 2, there is shown an inflatable flotation device 10 wearable by an intended user 11 (shown in FIG. 2). FIG. 2 illustrates schematically the head 13, neck 15, arms 17 and torso 19 of the intended user 11. The device 10 includes a body 12, a mounting system 14, and inflatable bladder 16 (shown in FIG. 2 for example), an inflation system 18 (shown in FIG. 3), a closure 20 and an attachment system 22.

The body 12 may be flexible or may be substantially rigid, so that the body 12 is substantially undeformed when first and second panels 42 and 44 extending therefrom move between open en closed configurations, as detailed below. For example, the body is made of a suitable rigid polymer. In the device 10, the body 12 is substantially U-shaped, or horseshoe shaped, and defines two body ends 27 and 29, across which a gap 21 extends to a neck receiving recess 26, but other configurations are within the scope of the invention. When the flotation device 10 is worn by the intended user 11, the gap 21 extends typically across the front of the neck 15 when the device 10 is worn by the intended user 11. The body 12 may define in some embodiments a receptacle 24 receiving the inflation system 18 thereinto. The receptacle 24 may be for example water-proof so that any electronic components of the inflation system 18, when present, are protected from the elements and from water. However, any other suitable configuration of the body 12 is within the scope of the invention.

The mounting system 14 is operatively coupled to the body 12 for mounting the device 10 to the intended user 11. In a specific embodiment of the invention, the mounting system 14 includes a collar 28 that can be secured around the neck 15 of the intended user 11. The collar 28 is for example mounted to the body 12 inside the neck receiving recess 26 and may include any suitable closure allowing one to open the collar 28 to position the collar 28 around the neck 15 and subsequently close the collar 28 to prevent accidental opening of the collar 28. An example of such a closure would be push buttons or complementary patches of miniature hook and loop materials, among others. In some embodiments, as seen in FIG. 5 in an alternative device 10', the mounting system 14' also includes a harness 30 including a chest strap 32 that can be secured around the torso 19 of the intended user, for example at the height of the arm pit area, and mounting straps 34 that extend between the body 12 and the chest strap 32. However, any other suitable configuration of the mounting system is within the scope of the invention. For example, the body 12 itself may be configured to allow the intended user to wear the device 10 securely.

Referring to FIG. 2, the inflatable bladder 16 is mounted to the body 12. For example, the inflatable bladder 16 is shaped generally substantially similarly to the body 12 and extends from an upper surface thereof. In some embodiments, more than one inflatable bladders 16 are provided. When deflated, the inflatable bladder 16 is in a deflated configuration in which the inflatable bladder 16 is compact enough to be contained within a cavity 31 formed by the body 12 and the closure 20 when the latter is closed. When in an inflated configuration, the inflatable bladder 16 has a larger volume than the volume defined by the closure 20 and the body 12. This volume is for example sufficient to allow the intended user to float on water with his head 13 over the surface of the water due to the additional buoyancy brought by the inflated bladder 16. To achieve this volume, there is a need for the closure 20 to be able to open itself to allow inflation of the bladder 16.

Referring to FIG. 3, the inflation system 18 is provided for selectively inflating the bladder 16. The inflation system 18 includes one or more cartridges 36 containing a compressed fluid and a valve 38 between the inflatable bladder 16 and the cartridges 36. In some embodiments, there is one valve 38 for each cartridge 36. The valve 38 is selectively openable to allow the compressed fluid to flow from the cartridges 36 to the bladder 16. In some embodiments, the valves 38 are operable manually, either through a mechanical or electrical system, so that the intended user can selectively open the valve 38. In some embodiments, a controller 40 is provided to selectively open the valves 38 under predetermined conditions. A non-limiting example of an inflation system 18 usable with the device 10 is described in Canadian patent applications 2,805,051 filed Jan. 31, 2013 and U.S. Pat. No. 2,720,574 filed Nov. 1, 2010, the contents of which is hereby incorporated by reference in its entirety.

Referring to FIG. 4, the closure 20 includes first and second panels 42 and 44 mounted to the body 12 with the body 12 extending therebetween. The first and second panels 42 and 44 define respectively first and second free edges 46 and 48 opposed to the body 12. The first and second panels 42 and 44 are configurable between a closed configuration (seen in FIG. 1 for example) and an open configuration (seen in FIG. 4 for example). In the closed configuration, the first and second panels 42 and 44 overlap each other adjacent the first and second free edges 46 and 48 and the first and second panels 42 and 44 and the body 12 together define the cavity 37 so that the inflatable bladder 16 is enclosed in the deflated configuration within the cavity 37. In the closed configuration, the first and second panels 42 and 44 may be attached to each other as detailed below. In the open configuration, the first and second panels 42 and 44 are detached from each other at the first and second free edges 46 and 48 with the first and second free edges 46 and 48 spaced apart from each other so that the inflatable bladder 16 is exposed. Typically, the first and second panels 42 and 44 are flexible, for example made of fabric or a polymer, so that the first and second panels 42 and 44 deform when the first and second panels 42 and 44 move between the open en closed configurations. However rigid first and second panels 42 and 44 hingedly mounted to the body 12 are also within the scope of the invention. In some embodiments, the first and second panels 42 and 44 are more flexible than the body 12, but bodies 12 having a structure similar to the first and second panels 42 and 44, for example made of fabric, are within the scope of the invention. In such embodiments, the first and second panels 42 and 44 may extend integrally as a single piece of material from the body 12.

The attachment system 22 is provided to maintain the first and second panels 42 and 44 secured to each other in the closed configuration. The attachment system 22 is configured so that when the bladder 16 is inflated, the pressure of the compressed fluid inside the bladder 16 opens the attachment system 32 as the latter abuts and expands against the first and second panels 42 and 44 to cause the first and second panels 42 and 44 to detach from each other to allow inflation of the bladder 16.

The attachment system 22 includes a first magnet 50 and a second magnet 52 mounted respectively to the first and second panels 42 and 44 respectively at the first and second free edges 46 and 48. The first and second magnets 50 and 52 are positioned so that in the closed configuration, the first and second magnets 50 and 52 are substantially in register with each other and face each other with opposite polarities to attach the first and second panels 42 and 44 to each other with a predetermined force. Therefore, a predetermined force is required to detach the first and second panels 42 and 44 from each other to achieve the open configuration. In some embodiments, the first and second magnets 50 and 52 are substantially elongated and extend along a major portion of the first and second panels 42 and 44 at the first and second free edges 46 and 48, for example along 50% or more, as seen in FIG. 6. In other embodiments, a plurality of smaller first and second magnets 50 and 52 are provided pairwise in register with each other along respectively the first and second free edges 46 and 48. The first and second magnets 50 and 52 may be embedded in the first and second panels 42 and 44 or may be fixed to the surface thereof, for example through sewing or using and adhesive, among other possibilities.

The predetermined force is such that the pressure inside the bladder 16 will result in separation from each other of the first and second magnets 50 and 52 relatively easily to allow opening of the closure 20, while minimizing the possibility that the first and second magnets 50 and 52 accidentally detach from each other when the bladder 16 is not inflated. The use of magnets to close the closure 20 is particularly advantageous as it facilitates closure of the closure 20 after the bladder 16 has been deflated and ensures that the force required for opening the closure 20 is well determined, which would not be the case if other systems in which overlap between two parts can be varied, such as Velcro™, were used.

In use, the first and second panels 42 and 44 are closed with the first and second panels 42 and 44 overlapping each other at the first and second free edges 46 and 48 so that the first and second panels 42 and 44 and body 12 enclose the inflatable bladder 16 in the deflated configuration, and so that the first and second magnets 52 and 54 attract each other. When one needs to inflate the inflatable bladder 16, for example after having accidentally fallen in water from a pleasure craft, the inflatable bladder 16 is inflated first until the inflatable bladder 16 abuts against the first and second panels 42 and 44. Further inflation of the inflatable bladder causes the first and second magnets 52 and 54 to move away from each other to open the first and second panels 42 and 44 to expose the inflatable bladder 16 and allow further inflation of the inflatable bladder 16. Such inflation is typically made in a single continuous action through release of the compressed gas from the cartridge 18 to the inflatable bladder 16, for example by breaking a seal provided therebetween. Once the intended user 11 has reached a safe location, the gas within the inflatable bladder 16 may be released to deflate the latter and the method of use can be repeated from the start.

Although the present document describes the magnetic closure system in the context of an inflatable collar, other types of flotation devices, for example inflatable life jackets or flotation devices mounted to inanimate structures could also use the same type of magnetic closure systems.

Although the present invention has been described hereinabove by way of preferred embodiments thereof, it can be modified, without departing from the spirit and nature of the subject invention as defined in the appended claims.

What is claimed is:

1. An inflatable flotation device wearable by an intended user, comprising:

a body;

a mounting system operatively coupled to the body for mounting the inflatable flotation device to the intended user;

an inflatable bladder mounted to the body and configurable between a deflated configuration and an inflated configuration;

an inflation system for selectively inflating the bladder from the deflated configuration to the inflated configuration, the inflation system including a cartridge containing a compressed fluid and a valve between the bladder and the cartridge, the valve being selectively openable to allow the compressed fluid to flow from the cartridge to the bladder;

first and second panels defining respectively first and second free edges, the first and second panels extending from the body from opposite the first and second free edges, the body extending between the first and second panels, the first and second panels being configurable between a closed configuration and an open configuration, wherein, in the closed configuration, the first and second panels overlap each other adjacent the first and second free edges and the first and second panels and the body together define a cavity, the inflatable bladder being enclosed in the deflated configuration within the cavity, and, in the open configuration, the first and second panels are detached from each other at the first and second free edges with the first and second free edges spaced apart from each other so that the inflatable bladder is exposed;

an attachment system including a first magnet and a second magnet mounted respectively to the first and second panels respectively at the first and second free edges, the first and second magnets being positioned so that in the closed configuration, the first and second magnets are substantially in register with each other and face each other with opposite polarities to attach the first and second panels to each other so that a predetermined force is required to detach the first and second panels from each other to achieve the open configuration.

2. The inflatable flotation device as defined in claim 1, wherein the first and second panels are flexible so that the first and second panels deform when the first and second panels move between the open en closed configurations.

3. The inflatable device as defined in claim 2, wherein the first and second panels are made of fabric.

4. The inflatable flotation device as defined in claim 2, wherein the body is substantially rigid so that the body is substantially undeformed when the first and second panels move between the open en closed configurations.

5. The inflatable flotation device as defined in claim 2, wherein the body is made of a polymer.

6. The inflatable flotation device as defined in claim 2, wherein the body is less flexible than the first and second panels.

7. The inflatable flotation device as defined in claim 1, wherein the mounting system includes a collar for mounting the inflatable flotation device around a neck of the intended user.

8. The inflatable flotation device as defined in claim 1, wherein the mounting system includes a harness for mounting the inflatable flotation device around a torso of the intended user.

9. The inflatable flotation device as defined in claim 1, wherein the body is substantially U-shaped and defines two body ends.

10. The inflatable flotation device as defined in claim 9, wherein the body is provided with a body attachment for selectively attaching the two body ends to each other.

11. The inflatable flotation device as defined in claim 1, wherein the first and second magnets are elongated and extend respectively along at least 50% of the first and second free edges.

12. The inflatable flotation device as defined in claim 1, wherein the attachment system including a plurality of first panel magnets mounted to the first panel spaced apart from each other along the first free edge and a plurality of second panel magnets mounted to the second panel spaced apart from each other along the second free edge, the first and second magnets being respectively part of the plurality of first and second panel magnets, each of the magnets from the plurality of first panel magnets facing and attracting a respective magnet from the plurality of second panel magnets in the closed configuration.

13. A method of operating an inflatable flotation device, the inflatable flotation device including an inflatable bladder and first and second panels extending from a body provided therebetween, the first and second panels defining respectively first and second free edges opposed to the body, the first and second panels being provided with respectively first and second magnets at respectively the first and second free edges, the method comprising:

(a) closing the first and second panels with the first and second panels overlapping each other at the first and second free edges so that the first and second panels and body enclose the inflatable bladder deflated and so that the first and second magnets attract each other; and (b) after step (a), inflating the inflatable bladder until the inflatable bladder abuts against the first and second panels;

(c) after step (b), continuing inflation the inflatable bladder to cause the first and second magnets to move away from each other to open the first and second panels to expose the inflatable bladder and allow further inflation of the inflatable bladder.

14. The method as defined in claim 13, wherein inflating the inflatable bladder includes breaking a seal between a compressed fluid cartridge and the inflatable bladder and transferring a compressed fluid from the compressed fluid cartridge to the inflatable bladder.

15. The method as defined in claim 13, further comprising, after step (c), deflating the inflatable bladder and performing step (a) again.

16. An inflatable flotation device wearable by an intended user and usable with an inflation system able to selectively provide a pressurized fluid, the inflatable flotation device comprising:

a body;

a mounting system operatively coupled to the body for mounting the inflatable flotation device to the intended user;

an inflatable bladder mounted to the body and configurable between a deflated configuration and an inflated configuration, the inflatable bladder being adapted to receive the pressurized fluid from the inflation system to change from the deflated configuration to the inflated configuration;

first and second panels defining respectively first and second free edges, the first and second panels extending from the body from opposite the first and second free edges, the body extending between the first and second panels, the first and second panels being configurable between a closed configuration and an open configuration, wherein, in the closed configuration, the first and second panels overlap each other adjacent the first and second free edges and the first and second panels and the body together define a cavity, the inflatable bladder being enclosed in the deflated configuration within the cavity, and, in the open configuration, the first and second panels are detached from each other at the first and second free edges with the first and second free edges spaced apart from each other so that the inflatable bladder is exposed;

an attachment system including a first magnet and a second magnet mounted respectively to the first and second panels respectively at the first and second free edges, the first and second magnets being positioned so that in the closed configuration, the first and second magnets are substantially in register with each other and face each other with opposite polarities to attach the first and second panels to each other so that a predetermined force is required to detach the first and second panels from each other to achieve the open configuration.

* * * * *